US005823436A

United States Patent [19]

Waldrum

[11] Patent Number: 5,823,436

[45] Date of Patent: Oct. 20, 1998

[54] MICRO ORIFICE NOZZLE HAVING FAN SPRAY PATTERN

[75] Inventor: John E. Waldrum, Ambler, Pa.

[73] Assignee: Waldrum Specialties, Inc., Doylestown, Pa.

[21] Appl. No.: 794,116

[22] Filed: Feb. 3, 1997

[51] Int. Cl.[6] ..... B05B 15/02

[52] U.S. Cl. ..... 239/123; 239/456; 239/556

[58] Field of Search ..... 239/451, 456, 239/460, 556, 107, 104, 123

[56] References Cited

U.S. PATENT DOCUMENTS

| | | | |
|---|---|---|---|
| 2,583,176 | 1/1952 | Hautau | 239/460 |
| 3,494,561 | 2/1970 | Buehler | 239/460 |
| 4,131,234 | 12/1978 | Pescetto | 239/457 |
| 4,484,711 | 11/1984 | Constantinescu et al. | 239/460 |
| 5,248,086 | 9/1993 | Waldrum et al. | 239/10 |
| 5,360,167 | 11/1994 | Grundy et al. | 239/460 |
| 5,518,183 | 5/1996 | Waldrum | 239/460 |

*Primary Examiner*—Andres Kashnikow
*Assistant Examiner*—Lisa Ann Douglas
*Attorney, Agent, or Firm*—Eckert Seamans Cherin & Mellott

[57] ABSTRACT

A fan spray nozzle provides a linear spray pattern of very fine droplets suitable for spraying thin invert emulsions containing active agents such as herbicides, pesticides, fungicides, growth regulators and the like, especially using an array of nozzles mounted on a moving vehicle. Each nozzle has a nozzle plug fitted into a nozzle body having an indentation complementary to the plug. A chamber in the body is coupled to the indentation and to an inlet for feeding pressurized liquid into the chamber. One or both of the nozzle plug and the nozzle body have a plurality of narrow grooves (0.001 to 0.015 inch or 25 to 400 microns in width), in a line along an abutment between the nozzle body and the nozzle plug and leading from the chamber to an external wall of the body. A manual release such as a thumbscrew holds the nozzle plug in the indentation, and when released enables the nozzle plug to pivot or hinge relative to the nozzle body, thereby separating the two and flushing the orifices in a direction limited to the direction of normal spray discharge. The hinging is facilitated by an elongated seal between the plug and the body along an edge of the indentation opposite from the orifices, and an O-ring on the shaft of the release that resiliently biases the plug to lift from the body.

12 Claims, 2 Drawing Sheets

MICRO ORIFICE NOZZLE HAVING FAN SPRAY PATTERN

BACKGROUND OF THE INVENTION

1. Field of the Invention

The invention concerns a nozzle adapted for pressurized application of liquid chemical agents such as herbicides, pesticides, fungicides, growth regulators and the like. The nozzle is suitable for spraying low viscosity liquids such as thin oil/water emulsions, and emits very small droplets of uniform size in a fan shaped spray pattern. The nozzle is configured for flushing of its orifices by a simple manual action that avoids a general emission of the active agent.

2. Prior Art

U.S. Pat. No. 5,518,183—Waldrum, which is hereby incorporated in its entirety, discloses a dispensing nozzle provided with uniform very small orifices having an internal cross sectional dimension of 0.001 to 0.015 inch (25 to 400 microns). The orifices are formed by slotting one or both of two preferably-conical abutting faces between an axial nozzle plug and an opening forming a seat for the plug in the wall of a cylindrical nozzle body. The small orifice size is such when spraying pressurized thin oil/water invert emulsions, the nozzle emits uniform small droplets due to surface tension and capillary action.

Uniform small droplet size is advantageous for effecting a more even application of a liquid product over a target area than is possible with thick emulsions or with aggregations of large and small droplets, permitting the use of much higher concentrations of active ingredients in the liquid sprayed. The uniform size also causes the sprayed droplets to move consistently with one another, which is advantageous for controlling drift. A number of appropriate compositions for the liquid product are disclosed in U.S. Pat. No. 5,248,086—Waldrum et al., which is also hereby incorporated in its entirety.

When spraying through small orifices, there is a potential problem with clogging of the orifices due to the accumulation of dried material and/or the capture at the orifices of particles entrained in the liquid. According to Waldrum '183, a nozzle plug as described can be threaded into the nozzle body to bear against the seat, such that the plug can be unthreaded manually to raise the plug from the seat, for exposing and flushing the orifices. This has the disadvantageous result, however, that at least the user's hand is sprayed with the liquid material, which is potentially harmful.

Alternatively according to Waldrum '183, the nozzle plug can be movable mounted in the nozzle body and resiliently held against the seat using a spring. The orifices in that case can be flushed by increasing the pressure of the liquid sufficiently to force the plug away from the seat against the resilient bias. Although this can be accomplished when the user is cleat of the discharge path, provision must be made for increasing the pressure. In addition, where a number of nozzles are being used in parallel, the nozzle plugs typically become displaced at different pressures due to differences in the springs.

In applying herbicides, pesticides, fungicides, plant growth regulators and similar active agents to an area to be treated, it is highly desirable for a number of reasons to apply only the minimum amount of the agent necessary to achieve the desired effect. Insofar as the agent is applied in an unnecessarily high density per unit surface area, or is applied in a form that is not readily absorbed, or is inadvertently discharged or caused to drift away from the target site in the air, or evaporates before it is absorbed, the agent is not only wasted, but is a form of pollution.

Waldrum '183 teaches that by making the droplet size small and uniform, a more even distribution of liquid is made than with a mix of larger and smaller droplets. Droplets inherently produce a locally high concentration of active agent at the point of impact of each droplet, with spaces between the points of impact. For a given quantity of liquid and a given surface area, uniform smaller droplets apply an active agent more evenly because the concentrations at the droplets are smaller and the droplets are more closely spaced than with larger droplets.

In addition to the matter of making the droplets small and uniform, even application of a liquid agent requires attention to the pattern of spray. In Waldrum '183, the spray is emitted axially around at least part of the circumference of a circular pattern of orifices along a circular junction between the seat in the nozzle body and the nozzle plug. In cross section the spray pattern is circular or semicircular. A conical seat causes the pattern to diverge radially proceeding axially away from the nozzle, such that the diameter of the circular or semicircular flow pattern increases with distance from the nozzle. Nevertheless, the cross sectional pattern is a circle or an arc.

A circular spray pattern is suited for some modes of application, but is not optimal for the most even application of liquid in other modes. A circular spray pattern, for example, can make an even application with manually carried spray wands positioned at a distance from a target area if the wand is moved in an oscillating circular pattern. A circular pattern is also useful for aerial spraying using an array of nozzles, because at this distance from the nozzles to the target the individual nozzle patterns merge into a general flow before reaching the target area.

If a circular spray pattern directed perpendicularly onto a surface, is moved along a relatively straight line over the surface to spray a swath, a less than uniform application results. Operating a nozzle while moving in a straight line is characteristic of spraying from ground vehicles and the like. Considering the moving circular spray pattern, areas directly on the center line of the swath are passed over perpendicularly by the leading and trailing edges of the circular spray pattern. Areas spaced from the center line by a distance near one radius of the circle are passed over more nearly tangentially by the pattern. Thus, areas near the edges of the swath receive more material than the middle of the swath.

What is needed is a nozzle for more evenly applying sprayed thin invert material in very small uniform droplets, particularly a nozzle that is optimized for spraying along a linear path, for example from a road vehicle, railroad car or the like.

SUMMARY OF THE INVENTION

It is an object of the invention to provide a nozzle for applying thin invert preparations in the form of uniform small droplets, particularly for providing a uniform density of application over a substantially linear spray swath.

It is also an object to provide an optimal nozzle structure having a fan shaped or linear pattern of spray jets, for even application of sprayed material when moving the nozzle in a direction substantially transverse of the linear pattern.

It is another object to provide a nozzle structure that can be opened manually for flushing the nozzle orifices, without producing a general emission of pressurized liquid.

It is another object to provide a nozzle in accordance with the foregoing aspects, employing resilient seals placed to prevent a general emission of the liquid while controlling opening of the nozzle structure for flushing.

These and other objects are accomplished by a fan spray nozzle providing a linear spray pattern of very fine droplets suitable for spraying thin invert emulsions containing active agents such as herbicides, pesticides, fungicides, growth regulators and the like, especially using an array of nozzles mounted en a moving vehicle. Each nozzle has a nozzle plug fitted into a nozzle body having an indentation complementary to the plug. A chamber in the body is coupled to the indentation and to an inlet for feeding pressurized liquid into the chamber. One or both of the nozzle plug and the nozzle body have a plurality of narrow grooves (0.001 to 0.015 inch or 25 to 400 microns in width), in a line along an abutment between the nozzle body and the nozzle plug and leading from the chamber to an external wall of the body. A manual release such as a thumbscrew holds the nozzle plug in the indentation, and when released enables the nozzle plug to pivot or hinge relative to the nozzle body, thereby separating the two and flushing the orifices in a direction limited to the direction of normal spray discharge. The hinging is facilitated by an elongated seal between the plug and the body along an edge of the indentation opposite from the orifices, and an O-ring on the shaft of the release that resiliently biases the plug to lift from the body.

The release has a threaded shaft affixing the nozzle plug to the nozzle body, having an axis aligned substantially transverse to a line of discharge through the orifices. The elongated seal between the nozzle body and the nozzle plug forms a hinge point and when the release is operated permits the plug to hinge away from the body at the orifices for flushing while limiting the direction of the flushing discharge to the normal direction of spray discharge.

The nozzle is particularly useful in an array mounted on a vehicle moving on a path, in that the elongation of the spray pattern can be oriented transverse to the direction of travel to produce a very even spray swath. For example, such an array is usefully mounted on a railroad car or other vehicle for plant growth regulation on and adjacent to the path of travel.

Other aspects of the invention will become apparent from the following description and the accompanying drawings, which are directed to nonlimiting exemplary embodiments.

BRIEF DESCRIPTION OF THE DRAWINGS

The drawings show embodiments of the invention that are presently preferred. It should be understood that the invention is not limited to the arrangements and instrumentalities shown in the drawings and is capable of embodiments in other groupings of parts, subassemblies and the like, in accordance with the scope of the invention claimed.

DETAILED DESCRIPTION OF THE INVENTION

The nozzle of the invention is especially useful for uniform application of active chemical agents. By providing for ultra-uniform application according to several aspects of the invention, the nozzle permits the chemical agent to be applied safely and efficiently even though the agent may be very highly concentrated in the liquid that carries it. The nozzle is used to spray a low viscosity liquid carrier with the active agent therein, such as a thin invert chemical composition as disclosed in U.S. Pat. No. 5,248,086—Waldrum et al., the disclosure of which is incorporated herein. The nozzle of the invention employs very small orifices to obtain uniform small droplet sizes as in U.S. Pat. No. 5,518,183—Waldrum, which is also hereby incorporated in its entirety, but provides certain advantages in that the nozzle of the invention produces a fan pattern and is arranged to limit the direction of discharge and to facilitate flushing the nozzle orifices without causing a general discharge of the carrier and active agent.

A "thin invert" is a water and oil composition that is agitated to obtain an emulsion. The nozzle of the invention is arranged for application of a thin invert chemical composition, by pumping the composition under pressure through small discharge orifices, e.g., of about 0.001 to 0.002 inches internal diameter. The water and oil phases become "inverted" in that the oil phase surrounds the water phase as the streams of emitted liquid subdivide into droplets by surface tension. Whereas the orifices are quite small and the chemical composition is thin in viscosity, the composition forms uniform droplets of about 250 to 300 microns maximum mean diameter, having an oil phase surrounding a water phase.

Figure 1:
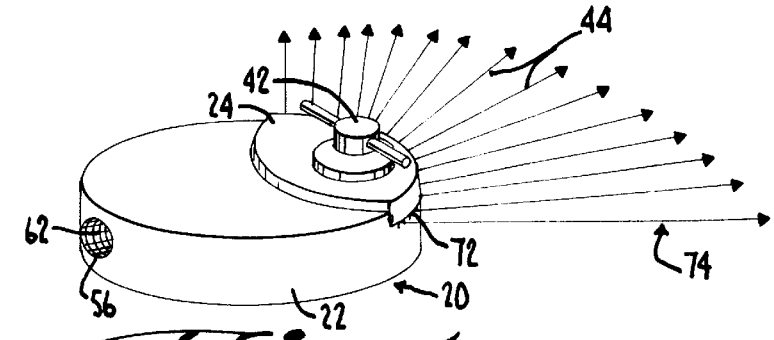
FIG. 1 is a perspective view of a micro-orifice nozzle having a fan spray pattern according to the present invention.
Figure 2:
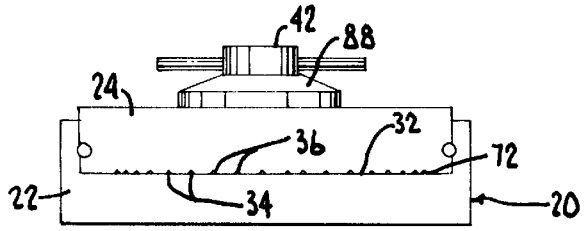
FIG. 2 is an elevation view of the nozzle, viewed along the centerline of the discharge pattern.

Referring to FIGS. 1 and 2, nozzle 20 generally includes a nozzle body 22 to which a nozzle plug 24 is attached. The discharge of liquid occurs along a line 32 of abutment between nozzle body 22 and plug 24, where orifices 34 are formed by grooves 36 in one or both of the abutting faces of the nozzle body and the nozzle plug. The nozzle plug 24 is held against nozzle body 22 by a release mechanism 42 that when operated allows nozzle plug 24 to be lifted from the line of abutment 32 with body 22, for flushing orifices 34 as explained in more detail below. At the same time, the structure confines the direction of discharge during flushing to the same direction 44 in which nozzle 20 generally sprays as shown in FIG. 1, namely when plug 24 bears directly against nozzle body 22 as in FIG. 2. This aspect of the invention is due to certain sealing and structural relationships that enable the respective seals to provide mechanical benefits, while sealing against leakage and inadvertent discharge.

Figure 3:
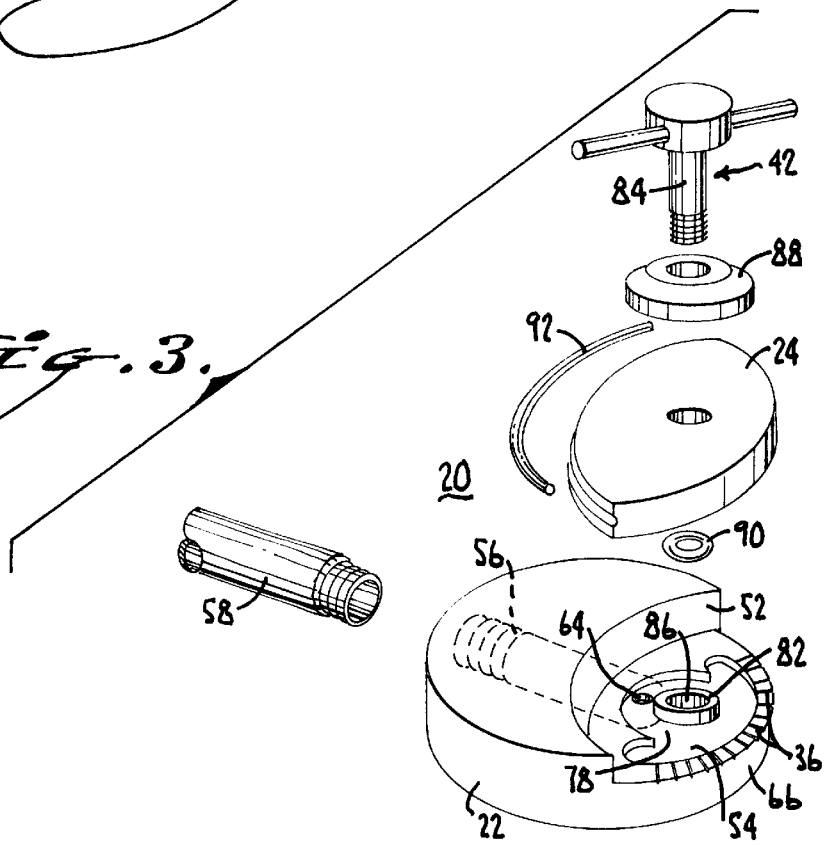
FIG. 3 is an exploded perspective view illustration the respective parts of the nozzle.

The same reference numbers are used throughout the drawings to identify corresponding elements. As shown in the exploded view of FIG. 3, nozzle body 22 according to this exemplary embodiment is generally a solid axially short cylinder. The nozzle body has an indentation 52 that is substantially complementary to the size and shape of nozzle plug 24. A chamber 54 in nozzle body 22 is formed at indentation 52 for receiving nozzle plug 24 and opens (upwardly in FIG. 3) toward the indentation. It would also be possible to form chamber 54 partly or wholly in nozzle plug 24, namely by providing a cavity on the underside of the nozzle plug as shown. An inlet 56 feeds pressurized liquid into chamber 54 from a flow line 58 that is coupleable to nozzle body 22, for example at a threaded bore 62. A second bore 64 leads from threaded bore 62 into chamber 54.

When in place as in FIGS. 1 and 2, nozzle plug 24 substantially closes chamber 54 but for the orifices 34. At least one of nozzle plug 24 and nozzle body 22 have a plurality of grooves 36 extending along the respective surfaces of abutment between the nozzle body and the nozzle plug. The grooves 36 extend outwardly from chamber 54 to an external wall 66 of nozzle body 22. Grooves 36 form a line 72 of orifices 34 for emission of the fluid in a fan shaped spray pattern 74. In the embodiment shown, the external wall 66 of body 22 is circular and grooves 36 are perpendicular to the surface of wall 66 in a generally diverging arc. It is also possible to have grooves 36 aligned parallel to one another, to align the grooves other than perpendicular to the surface and/or to employ a flat external wall 66 with an otherwise cylindrical body or with a rectilinear nozzle body (not shown). In any event, the spray pattern forms a fan 74 in which the jets of sprayed liquid and the droplets thereby formed fall substantially along a line.

Chamber 54 is shaped and dimensioned to provide for flow from input 56, connected by bore 64 to open at a wide inner part 78 of chamber 54, to each of the orifice-forming grooves 36. The width of portions of chamber 54 can be varied to manage the flow to the particular orifices if needed, for example, to provide for less obstructed flow to orifices from which it is desirable to emit relatively stronger streams in order to cause droplets to travel further from the nozzle than others. This is useful, for example, when mounting nozzle 20 so as to emit a vertically elongated fan pattern in that the upper orifices can be arranged to emit streams that are directed further from the nozzle than those of lower orifices. In the embodiment shown, in which the grooves are divergent and disposed on an arc, streams from upper orifices in a vertically elongated fan pattern will naturally travel out and over those of the lower orifices due to the difference in the angle of their discharge, which is such that upper streams are lofted over downwardly directed lower streams.

According to an inventive aspect, a manually operable release mechanism 42 affixes nozzle plug 24 in indentation 52 as shown in FIGS. 1 and 2. A central boss 82 in nozzle body 22 is threaded and arranged to receive a thumbscrew 84 that extends through a central hole 86 in nozzle plug 24, preferably with an intermediate washer 88. When thumbscrew 84 is tightened, nozzle plug 24 closes chamber 54 but for inlet 56 (i.e., bore 64) and outlet orifices 34, the sizes of which are defined by the cross sectional dimension of grooves 36 (normally all equal for emitting uniform droplet sizes). In that case nozzle 20 discharges only in the direction of grooves 36. Release 42 can be loosened, in this case by unthreading thumbscrew 84, which permits nozzle plug 24 and nozzle body 22 to be relatively separated at the line 72 of orifices 34. Separating plug 24 and body 22 enlarges the flow path available for discharge and nozzle 20 emits a quantity of liquid from the pressurized source for flushing any accumulation of potentially clogging material from orifices 34.

To prevent leakage between nozzle body 22 and nozzle plug 24, one or more seals is disposed between the nozzle plug and the nozzle body for sealing chamber 54 of nozzle body 22 relative to the nozzle plug and relative to release mechanism 42 where such parts meet at points remote from the line 72 of orifices. According to a farther inventive aspect, the one or more seals 90, 92 are arranged to restrict emission of the fluid to line 72 of orifices when nozzle plug 24 and body 22 are separated for flushing orifices 34 as well as when the two are engaged tightly by release mechanism 42, which comprises a threaded shaft 84 having an axis aligned substantially transverse to the line of discharge through the orifices.

Figure 4:
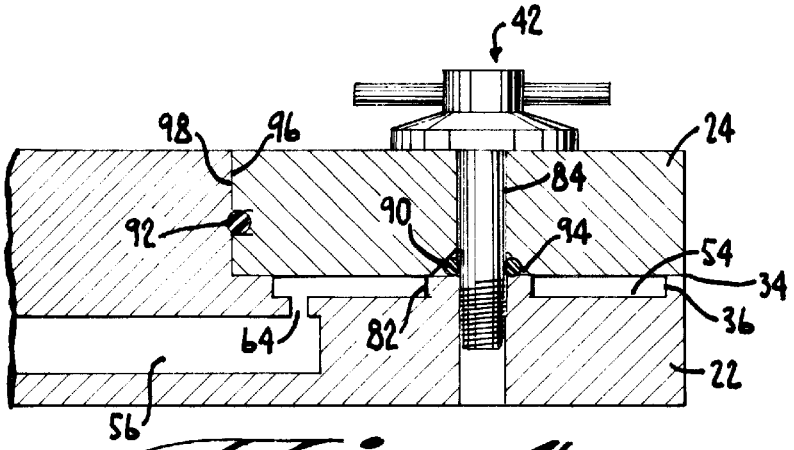
FIG. 4 is a partial section view thereof.

Referring also to the sectional view of FIG. 4, the sealing means between the nozzle body and the nozzle plug seals relative to the release mechanism. On its inner side, nozzle plug 24 has a conical depression 94 adjacent to threaded shaft 84 of release 42, in which an O-ring 90 is mounted for sealing between shaft 84, nozzle body 22 and nozzle plug 24. O-ring 90 is compressed by nozzle plug 24 against the central boss 82 in chamber 54. As a result, O-ring 90 not only seals but also exerts a resilient bias urging plug 24 to lift from body 22. The release thumbscrew 84 normally holds the plug against the body so that the grooves are covered over. However, as shown in FIG. 4, when the release is operated to remove clamping pressure from the nozzle plug, O-ring 90 causes nozzle plug 24 to lift and opens a slot between the plug and body 22, through which liquid is discharged for flushing orifices 34.

The cross sectional view of FIG. 4 also illustrates the elongated inner seal 92 disposed in a slot on an inner side 96 of nozzle plug 24, sealing between nozzle plug 24 and a facing wall 98 of nozzle body 22, namely the side of indentation 52. The elongated seal 92 is preferred for confining the discharge of liquid to the area of orifices 34 and preventing discharge or leakage around the abutment of inner wall 96 of plug 24 and facing wall 98 of body 22.

When the thumbscrew release mechanism is operated as in FIG. 4 for flushing orifices 34, elongated seal 92 remains pressed against facing wall 98 of nozzle body 22 substantially to the same extent as when the release mechanism is clamping down on the nozzle plug 24, because in this embodiment the release mechanism comprises a bolt having an axis perpendicular to the generally planar nozzle plug 24. Thus elongated seal 92 remains engaged against nozzle body 22 and restricts displacement of the rear or inner part of nozzle plug 24 from nozzle body 22. This provides a hinge-like action. When the release is opened, nozzle plug 24 pivots slightly relative to elongated seal 92, hinging open at the discharge side but not substantially opening at the rear side where elongated seal 92 continues to prevent discharge of liquid.

Figure 5:
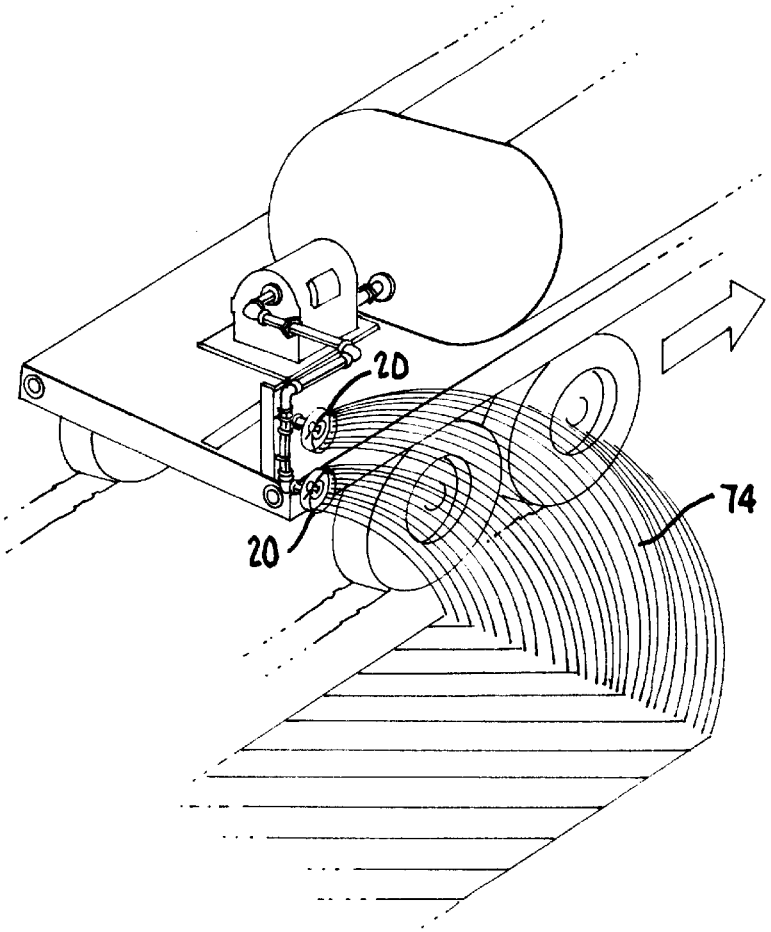
FIG. 5 is an partial perspective view showing use of two nozzles in an array mounted on a vehicle, spraying in horizontal and vertical fan patterns, respectively.

As shown in FIG. 5, nozzles 20 can be provided in an array, for example on a vehicle such as a truck or rail car, for directing one or more fan shaped patterns 74 laterally outwardly, to the rear, etc. The pattern 74 is advantageously arranged to substantially apply a line of liquid spray in uniform small droplets, the line extending transverse of a direction of travel, e.g., extending substantially perpendicular to the direction of travel as shown in FIG. 5. This allows for a very uniform application, which together with the small orifice size and thin invert composition enables application of active agents in high concentrations, with safety and efficiency.

In FIG. 5, one of the nozzles 20 directs a fan pattern laterally outwardly from the vehicle, with the fan pattern being elongated vertically due to the orientation of nozzle 20. The other nozzle 20 directs a fan pattern rearwardly, with the pattern being elongated horizontally. With a vertically elongated fan pattern sprayed using a nozzle that has equiangularly spaced grooves of equal dimension, a higher concentration of material would be applied close to the nozzle, where spray jets are close together and directed downwardly, than at a distance from the nozzle, where the jets are lofted outward in parabolic arcs based on the orientation of the emitting grooves. In order to improve the evenness of application, it is possible to vary either or both of the density and the size of the grooves in order to reduce this effect. For example, the upward directed jets from the lateral nozzle in FIG. 5 can be emitted through larger or more numerous grooves than the lower directed jets. Preferably, this is accomplished in stages so that all the grooves are not different in size. For example, the downward jets can be emitted through grooves of 0.005 inch, the upward jets through grooves of 0.015 inch, and the central jets through grooves of 0.010 inch. Alternatively, the upper grooves can be more closely spaced than the lower ones according to a similar technique for varying the spray density at the nozzle to achieve a more even spray density at the point of application. For the rearward facing nozzle, the line of application is more even, but it is possible to reduce the density or size of the grooves near the outside of the pattern to reduce the relative variations in application that result inherently from the partly circular fan pattern.

The invention having been disclosed in connection with certain preferred embodiments and examples, variations will now be apparent to persons skilled in the art. The invention is intended to encompass a reasonable range of embodiments that are equivalent to those disclosed as examples. Accordingly, reference should be made to the appended claims rather than the foregoing examples, to assess the scope of exclusive rights in the invention claimed.

I claim:

1. A nozzle comprising:

a nozzle body having an inlet for a fluid under pressure, the inlet leading into a chamber in the nozzle body, the chamber being open over a part of a surface of the nozzle body;

a nozzle plug attachable to the nozzle body over said part of the surface of the nozzle body, so as to substantially close the chamber, at least one of the nozzle plug and the nozzle body having a plurality of grooves extending between the chamber and an external wall of the nozzle body, forming a line of orifices for emission of the fluid in a fan shaped spray pattern;

a manually operable release affixing the nozzle plug to the nozzle body, the release enabling the nozzle plug and the nozzle body to be relatively separated at the line of orifices for flushing the orifices;

a seal disposed between the nozzle plug and the nozzle body for sealing the chamber remote from the line of orifices, the seal restricting emission of the fluid to the line of orifices during said flushing; and, wherein the release comprises a threaded shaft affixing the nozzle plug to the nozzle body, the threaded shaft being aligned substantially transverse to a line of discharge through said orifices.

2. The nozzle of claim 1, wherein the seal comprises an O-ring bearing between the shaft, the nozzle body and the nozzle plug.

3. The nozzle of claim 2, wherein the O-ring is compressed between the nozzle body and the nozzle plug, such that the O-ring provides a resilient bias urging the nozzle body and the nozzle plug to separate.

4. The nozzle of claim 1, wherein the seal comprises an elongated seal disposed between the nozzle body and the nozzle plug along an edge of the nozzle plug spaced from the shaft.

5. The nozzle of claim 4, wherein the elongated seal bears between the nozzle plug and the nozzle body in a direction perpendicular to the threaded shaft, whereby the elongated seal forms a hinge point between the nozzle body and the nozzle plug as the release is operated.

6. A fan spray nozzle comprising:

a nozzle plug;

a nozzle body having an indentation complementary to the nozzle plug for receiving the nozzle plug, a chamber coupled to the indentation and an inlet for feeding pressurized liquid into the chamber, the nozzle plug substantially closing the chamber, at least one of the nozzle plug and the nozzle body having a plurality of grooves extending along an abutment between the nozzle body and the nozzle plug from the chamber to an external wall of the nozzle body, the grooves forming a line of orifices for emission of the fluid in a fan shaped spray pattern;

a manually operable release affixing the nozzle plug in the indentation, the release enabling the nozzle plug and the nozzle body to be relatively separated at the line of orifices for flushing the orifices;

a seal disposed between the nozzle plug and the nozzle body for sealing the chamber remote from the line of orifices, the seal restricting emission of the fluid to the line of orifices during said flushing; and, wherein the release comprises a threaded shaft affixing the nozzle plug to the nozzle body, the threaded shaft being aligned substantially transverse to a line of discharge through said orifices.

7. The fan spray nozzle of claim 6, wherein the seal comprises an O-ring bearing between the shaft, the nozzle body and the nozzle plug.

8. The fan spray nozzle of claim 7, wherein the O-ring is compressed between the nozzle body and the nozzle plug, such that the O-ring provides a resilient bias urging the nozzle body and the nozzle plug to separate.

9. The fan spray nozzle of claim 8, wherein the seal comprises an elongated seal disposed in the indentation, between the nozzle body and the nozzle plug along an edge of the nozzle plug spaced from the shaft.

10. The fan spray nozzle of claim 9, wherein the elongated seal bears between the nozzle plug and the nozzle body in a direction perpendicular to the threaded shaft, whereby the elongated seal forms a hinge point between the nozzle body and the nozzle plug as the release is operated.

11. The fan spray nozzle of claim 6, wherein the seal comprises an elongated seal disposed in the indentation, between the nozzle body and the nozzle plug along an edge of the nozzle plug spaced from the shaft.

12. The fan spray nozzle of claim 11, wherein the elongated seal bears between the nozzle plug and the nozzle body in a direction perpendicular to the threaded shaft, whereby the elongated seal forms a hinge point between the nozzle body and the nozzle plug as the release is operated.

* * * * *